US007640763B2

(12) United States Patent
Nishimura et al.

(10) Patent No.: US 7,640,763 B2
(45) Date of Patent: Jan. 5, 2010

(54) HOT WATER SUPPLY SYSTEM

(75) Inventors: Tadafumi Nishimura, Osaka (JP); Takahiro Yamaguchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 552 days.

(21) Appl. No.: 11/630,617

(22) PCT Filed: Jul. 1, 2005

(86) PCT No.: PCT/JP2005/012218

§ 371 (c)(1),
(2), (4) Date: Dec. 22, 2006

(87) PCT Pub. No.: WO2006/004046

PCT Pub. Date: Jan. 12, 2006

(65) Prior Publication Data

US 2009/0211282 A1 Aug. 27, 2009

(30) Foreign Application Priority Data

Jul. 1, 2004 (JP) ..... 2004-195154

(51) Int. Cl.
*F25B 27/00* (2006.01)

(52) U.S. Cl. ..... 62/238.6; 62/332

(58) Field of Classification Search ..... 62/238.6–238.7, 62/332–335

See application file for complete search history.

(56) References Cited

U.S. PATENT DOCUMENTS 4,194,368 A * 3/1980 Bahel et al. ..... 62/238.6
4,391,104 A * 7/1983 Wendschlag ..... 62/79
4,949,547 A * 8/1990 Shimizu ..... 62/79
5,335,508 A * 8/1994 Tippmann ..... 62/129
6,874,326 B2 4/2005 So et al.

FOREIGN PATENT DOCUMENTS

| | | | |
|---|---|---|---|
| CN | 2413237 | Y | 1/2001 |
| CN | 1451935 | A | 10/2003 |
| CN | 1467441 | A | 1/2004 |
| JP | 04-263758 | A | 9/1992 |
| JP | 2002-364912 | A | 12/2002 |
| JP | 2003-056905 | A | 2/2003 |
| JP | 2003-222395 | A | 8/2003 |

* cited by examiner

*Primary Examiner*—William E Tapolcai
(74) *Attorney, Agent, or Firm*—Birch, Stewart, Kolasch & Birch, LLP

(57) ABSTRACT

A hot water supply system (10) is provided which includes a first refrigerant circuit (20), an intermediate temperature water circuit (40), a second refrigerant circuit (60), and a high temperature water circuit (80). The first refrigerant circuit (20) constitutes a heat pump which uses the outdoor air as a heat source, and heats heat transfer water in the intermediate temperature water circuit (40). In the intermediate temperature water circuit (40), the heat transfer water is circulated between a radiator (45) for floor heating and a first heat exchanger (30) and between a second heat exchanger (50) and the first heat exchanger (30). The second refrigerant circuit (60) constitutes a heat pump which uses the heat transfer water in the intermediate temperature water circuit (40) as a heat source, and heats water for hot water supply in the high temperature water circuit (80).

7 Claims, 4 Drawing Sheets

HOT WATER SUPPLY SYSTEM

TECHNICAL FIELD

The present invention relates to a hot water supply system which employs a heat pump.

BACKGROUND ART

Hot water supply systems are known in the conventional technology wherein hot water, produced by making use of a heat pump, is supplied to where it is utilized (hereinafter referred to as the "utilization side").

For example, Patent Document I discloses a hot water supply system in which high temperature water at about 90 degrees Centigrade is produced in a single heat pump unit and then stored in a hot water storage tank. The high temperature hot water stored in the hot water storage tank is supplied to the utilization side. The hot water supply system of Patent Document I produces intermediate temperature water by heat exchange with high temperature water and supplies the produced intermediate temperature water to heat utilization equipment such as a radiator for floor heating.

In addition, Patent Document II discloses a hot water supply system in which high temperature water at about 90 degrees Centigrade and intermediate temperature water at about 60-80 degrees Centigrade are separately produced in a single heat pump unit. The hot water supply system of Patent Document II supplies the produced high temperature water to the utilization side while supplying the produced intermediate temperature water to heat utilization equipment such as a radiator for floor heating.

Patent Document I: JP 2003-056905A

Patent Document II: JP 2002-364912A

DISCLOSURE OF THE INVENTION

Problems that the Invention Intends to Solve

However, the problem associated with the hot water supply system disclosed in Patent Document I (i.e., the hot water supply system of the type which produces intermediate temperature water from high temperature water) is that, even in an operation condition which requires only a supply of intermediate temperature water, it is inevitably necessary to first produce high temperature water for the production of intermediate temperature water. For this reason, in regard to this type of hot water supply system, the amount of energy consumption, e.g., the amount of electric power consumption, may become excessive.

In addition, the problem associated with the hot water supply system disclosed in Patent Document II (i.e., the hot water supply system of the type which separately produces high temperature water and intermediate temperature water in a single heat pump) is that two types of hot water having different temperatures have to be produced by heat exchange with a refrigerant circulating in a single refrigerant circuit. If the refrigeration cycle condition of the refrigerant circuit is set to, for example, a condition suitable for producing high temperature water, this setting limits the temperature of available intermediate temperature water. As a result of this, the possibility exists that it becomes difficult to perform proper operation control on the hot water supply system. For example, it may become impossible to set the temperature of intermediate temperature water in response to a request from the utilization side.

With the above-problem in mind, the present invention was made. Accordingly, an object of the present invention is to provide an improved hot water supply system in that the amount of energy consumption (e.g., the amount of electric power consumption) is reduced; the temperature of hot water to be supplied can be set with a wide degree of latitude; and its operation control is facilitated.

Means for Solving the Problems

The present invention provides, as a first aspect, a hot water supply system which, in addition to being capable of operation to supply hot water to a utilization side, is also capable of operation to supply to a heat utilization unit (45) a heating medium as a heating fluid having an intermediate temperature lower than the temperature of the hot water. The hot water supply system of the first aspect comprises a heating medium passageway (40) for causing the heating medium to circulate between the hot water supply system and the heat utilization unit (45), a first refrigerant circuit (20) which performs a refrigerant cycle by causing a first refrigerant to circulate and which heats the heating medium in the heating medium passageway (40) up to the intermediate temperature by heat exchange with the first refrigerant, and a second refrigerant circuit (60) which performs a refrigeration cycle by causing a second refrigerant to circulate and which heats water with the second refrigerant to thereby produce hot water for hot water supply, wherein the second refrigerant circuit (60) comprises an evaporator which causes the second refrigerant to exchange heat with the heating medium in the heating medium passageway (40) and which constitutes a heat pump using the heating medium in the heating medium passageway (40) as a heat source.

The present invention provides, as a second aspect according to the first aspect, a hot water supply system wherein the heating medium passageway (40) is capable of operation to supply the heating medium after passage through the heat utilization unit (45) to the evaporator (50) of the second refrigerant circuit (60).

The present invention provides, as a third aspect according to the first aspect, a hot water supply system wherein the heating medium passageway (40) is capable of operation to distribute the heating medium heated up to the intermediate temperature to the heat utilization unit (45) and the evaporator (50) of the second refrigerant circuit (60).

The present invention provides, as a fourth aspect according to either the second aspect or the third aspect, a hot water supply system wherein the heating medium passageway (40) is capable of operation to supply the heating medium heated up to the intermediate temperature only to the evaporator (50) of the second refrigerant circuit (60).

The present invention provides, as a fifth aspect according to any one of the first to fourth aspects, a hot water supply system wherein the first refrigerant circuit (20) is provided with a heat exchanger unit (24) for air conditioning which causes the first refrigerant to exchange heat with indoor air.

The present invention provides, as a sixth aspect according to the fifth aspect, a hot water supply system wherein the first refrigerant circuit (20) is selectively switchable between a first mode of operation in which the air conditioning heat exchanger unit (24) becomes an evaporator and a second mode of operation in which the air conditioning heat exchanger unit (24) becomes a condenser.

The present invention provides, as a seventh aspect according to the first aspect, a hot water supply system wherein either or both of the first refrigerant circuit (20) and the second refrigerant circuit (60) are provided in plural numbers while only one heating medium passageway (40) is provided, and wherein the first refrigerant in each of the first refrigerant circuits (20) and the second refrigerant in each of the second refrigerant circuits (60) exchange heat with the heating medium circulating in the only one heating medium passageway (40).

Working

In the first aspect of the present invention, it becomes possible to accomplish not only an operation of providing a supply of hot water to the utilization side but also an operation of providing a supply of intermediate temperature heating medium to the heat utilization unit (45). In the first refrigerant circuit (20), the first refrigerant is circulated to thereby perform a refrigeration cycle. Sometime during that period, the first refrigerant dissipates heat to the heating medium in the heating medium passageway (40) and condenses. The heating medium flowing through the heating medium passageway (40) is heated by the first refrigerant up to the intermediate temperature. Thereafter, the intermediate temperature heating medium is delivered to the heat utilization unit (45) and to the evaporator (50) of the second refrigerant circuit (60). In the heat utilization unit (45), a target for heating such as indoor air et cetera is heated using the supplied heating medium. In the second refrigerant circuit (60), the second refrigerant is circulated to thereby perform a refrigerant cycle. Sometime during that period, the second refrigerant absorbs heat from the heating medium in the heating medium passageway (40) and evaporates. In other words, the second refrigerant circuit (60) constitutes a heat pump that uses the heating medium as a heat source. In the hot water supply system (10) of the first aspect, hot water for the purpose of hot water supply is produced by heating water with the second refrigerant in the second refrigerant circuit (60).

In the second aspect of the present invention, in the heating medium passageway (40), it becomes possible to accomplish an operation of supplying the heating medium after passage through the heat utilization unit (45) to the evaporator (50) of the second refrigerant circuit (60). During this operation, in the heating medium passageway (40), the evaporator (50) of the second refrigerant circuit (60) is located downstream of the heat utilization unit (45) in the circulation direction of the heating medium, and the heating medium having a somewhat lowered temperature as a result of its heat dissipation in the heat utilization unit (45) exchanges heat with the second refrigerant in the evaporator (50) of the second refrigerant circuit (60). In addition, during this operation, the first refrigerant in the first refrigerant circuit (20) exchanges heat with the heating medium having a further lowered temperature as a result of its heat dissipation to the second refrigerant.

In the third aspect of the present invention, in the heating medium passageway (40), it becomes possible to accomplish an operation of distributing the heating medium heated as a result of heat exchange with the first refrigerant to the heat utilization unit (45) and the evaporator (50) of the second refrigerant circuit (60). During this operation, in the heating medium passageway (40), the intermediate temperature heating medium is supplied not only to the heat utilization unit (45) but also to the evaporator (50) of the second refrigerant circuit (60) and, in the evaporator (50) of the second refrigerant circuit (60), the second refrigerant absorbs heat from the intermediate temperature heating medium.

In the fourth aspect of the present invention, in the heating medium passageway (40), it becomes possible to accomplish an operation of supplying the heating medium heated up to the intermediate temperature only to the evaporator (50) of the second refrigerant circuit (60). This operation is carried out when there is no need for the heat utilization unit (45) to heat any target for heating.

In the fifth aspect of the present invention, the air conditioning heat exchanger unit (24) is disposed along the first refrigerant circuit (20). The first refrigerant circulating in the first refrigerant circuit (20) is also delivered to the air conditioning heat exchanger unit (24). The air conditioning heat exchanger unit (24) causes a stream of indoor air to exchange heat with the first refrigerant to thereby either cool or heat the indoor air stream.

In the sixth aspect of the present invention, during the operation in which the air conditioning heat exchanger unit (24) becomes an evaporator, indoor air is cooled in the air conditioning heat exchanger unit (24). On the other hand, during the operation in which the air conditioning heat exchanger unit (24) becomes a condenser, indoor air is heated in the air conditioning heat exchanger unit (24). In the hot water supply system (10) of the sixth aspect of the present invention, it becomes possible to selectively make switching between a cooling mode of operation in which the indoor air is cooled in the air conditioning heat exchanger unit (24) and a heating mode of operation in which the indoor air is heated in the air conditioning heat exchanger unit (24).

In the seventh aspect of the present invention, either or both of the first refrigerant circuit (20) and the second refrigerant circuit (60) are provided in plural numbers, and these first and second refrigerant circuits (20, 60) are fluidly connected to the single heating medium passageway (40). For example, if the first refrigerant circuit (20) is provided in plural numbers, this enables the first refrigerant in each of all the first refrigerant circuits (20) to exchange heat with the heating medium in the heating medium passageway (40). On the other hand, if the second refrigerant circuit (60) is provided in plural numbers, this enables the second refrigerant in each of all the second refrigerant circuits (60) to exchange heat with the heating medium in the heating medium passageway (40).

ADVANTAGEOUS EFFECTS OF THE INVENTION

In the first aspect of the present invention, the first refrigerant circuit (20) performs a refrigeration cycle to thereby heat the heating medium in the heating medium passageway (40), and the second refrigerant circuit (60) performs, using the heated heating medium as a heat source, a refrigeration cycle to thereby produce a supply of hot water for hot water supply. Consequently, for example, when there is no need to provide a supply of hot water while on the other hand it is necessary to provide a supply of heating medium to the heat utilization unit (45), it suffices to operate only the first refrigerant circuit (20), and there is no need to place the second refrigerant circuit (60) in operation in order to produce hot water for hot water supply. Therefore, in accordance with the first aspect of the present invention, unlike the conventional technology, the producing of high temperature hot water in order just to obtain only an intermediate temperature heating medium is no longer required, thereby making it possible to suppress wasteful consumption of energy such as electric power et cetera.

In addition, in the hot water supply system (10) of the first aspect of the present invention, if the demand for intermediate temperature heating medium or the desired value of the temperature of heating medium is changed, it suffices to adjust the amount of heating which is applied to the heating medium by changing the operational state of the first refrigerant circuit (20). If the demand for the supply of hot water or the desired value of the temperature of supply hot water is changed, it suffices to adjust the amount of heating which is applied to the water by changing the operational state of the second refrigerant circuit (60). Therefore, in accordance with the first aspect of the present invention, it becomes possible to properly respond to a change in the demand for intermediate temperature heating medium or the demand for the supply of hot water by individually performing operational control on the first refrigerant circuit (20) and the second refrigerant circuit (60), and it is possible to realize the hot water supply system (10) which is easily operation-controlled depending on the variation in load.

In the second aspect of the present invention, it becomes possible to accomplish an operation of supplying the heating medium after passage through the heat utilization unit (45) to the evaporator (50) of the second refrigerant circuit (60). During this operation, heat exchange is effected between the heating medium having a further lowered temperature as a result of its heat dissipation to the second refrigerant and the first refrigerant in the first refrigerant circuit (20). Consequently, the enthalpy of the first refrigerant after heat exchange with the heating medium is lowered, thereby making it possible to increase the amount of heat that the first refrigerant absorbs from the heat source such as outside air et cetera. As a result, the COP (coefficient of performance) of the refrigeration cycle in the first refrigerant circuit (20) is improved.

In the third aspect of the present invention, it becomes possible to accomplish an operation of distributing the heating medium heated as a result of heat exchange with the first refrigerant to the heat utilization unit (45) and the evaporator (50) of the second refrigerant circuit (60). During this operation, the second refrigerant in the second refrigerant circuit (60) absorbs heat from the intermediate temperature heating medium. In other words, in the third aspect of the present invention, the second refrigerant in the second refrigerant circuit (60) is made to exchange heat with the heating medium heated as high as possible. Therefore, in accordance with the third aspect of the present invention, the low pressure of the refrigeration cycle in the second refrigerant circuit (60) can be set at a rather high level, thereby making it possible to reduce the COP of the refrigeration cycle by reducing the amount of power required to compress the second refrigerant.

In accordance with the fourth aspect of the present invention, it becomes possible to interrupt the supply of heating medium to the heat utilization unit (45) which is not requested to operate. This therefore makes it possible to avoid loss in the heat dissipation of the heating medium in the heat utilization unit (45) which is not requested to operate.

In accordance with the fifth and sixth aspects of the present invention, it becomes possible to provide room air conditioning by making use of the first refrigerant circuit (20) of the hot water supply system (10). This therefore makes it possible to achieve more space-savings in the installation of equipment when compared to the case where the hot water supply system (10) is installed separately from an air conditioning apparatus. Especially, in accordance with the sixth aspect of the present invention, it becomes possible to selectively make a switch between the cooling mode of operation and the heating mode of operation, thereby enhancing the air conditioning function of the hot water supply system (10).

In accordance with the seventh aspect of the present invention, either or both of the first refrigerant circuit (20) and the second refrigerant circuit (60) are provided in plural numbers in the hot water supply system (10) and these refrigerant circuits are fluidly connected to the single heating medium passageway (40). As a result of such arrangement, for the case where, for example, the first refrigerant circuit (20) is provided in plural numbers, when only the operation of a single first refrigerant circuit (20) fails to apply a sufficient amount of heating to the heating medium, it becomes possible to place a different first refrigerant circuit (20) in operation. Therefore, in accordance with the seventh aspect of the present invention, it is possible to realize the hot water supply system (10) capable of responding to a variation in the load with flexibility and having high usability.

REFERENCE NUMERALS IN DRAWINGS

Figure 1:
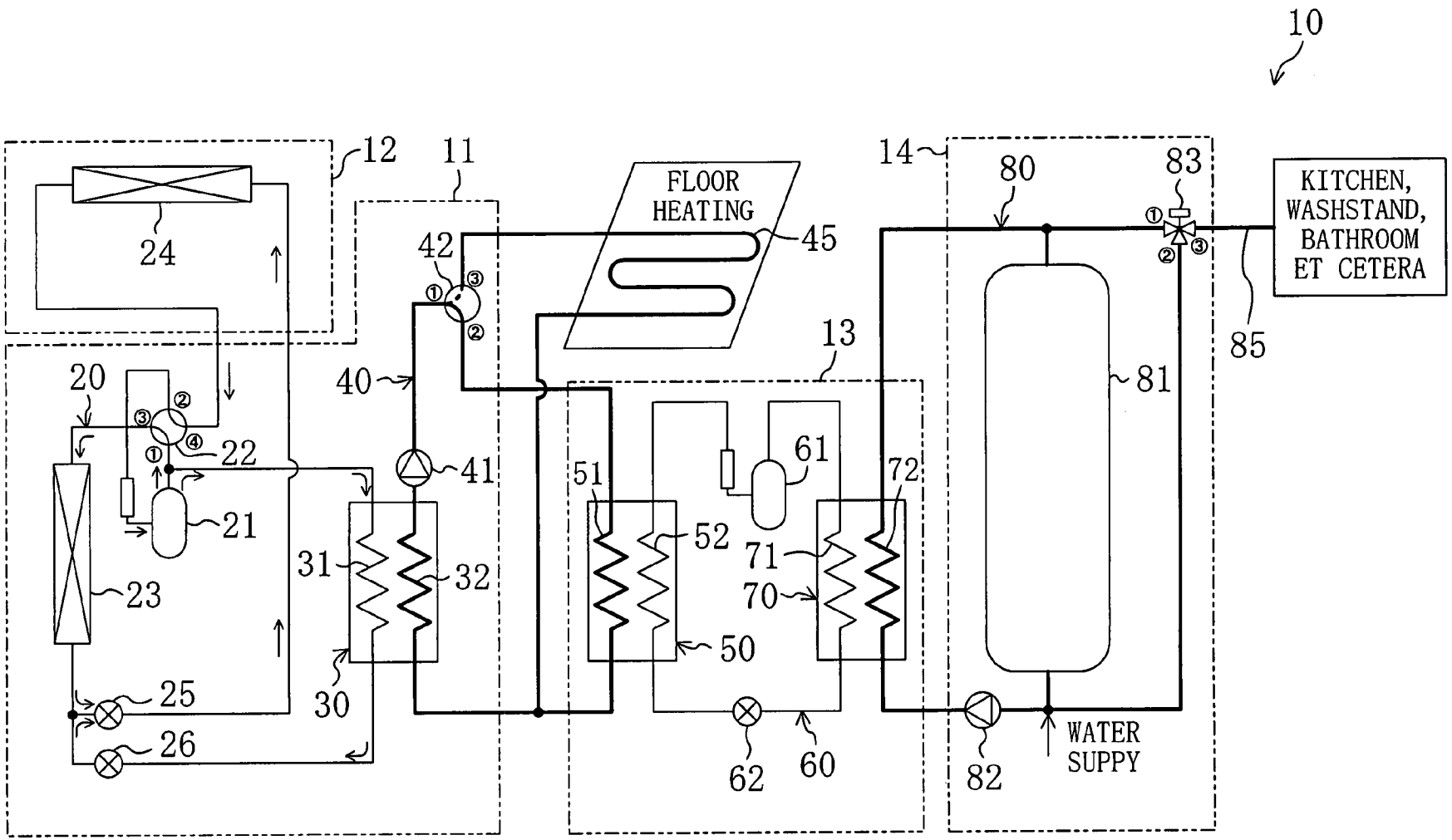
FIG. 1 is a piping schematic diagram showing a general configuration of a hot water supply system in an embodiment of the present invention, and an operation thereof during the cooling mode of operation.

10: hot water supply system
20: first refrigerant circuit
24: air conditioning heat exchanger unit
40: intermediate temperature water circuit (heating medium passageway)
45: floor heating radiator (heat utilization unit)
50: second heat exchanger (second refrigerant circuit's evaporator)
60: second refrigerant circuit

BEST EMBODIMENT MODE FOR CARRYING OUT THE INVENTION

In the following, embodiments of the present invention are described in detail with reference to the drawing figures.

First Embodiment of the Invention

As shown in FIG. 1, a hot water supply system (10) as a first embodiment of the present invention is made up of a heat source unit (11), an indoor unit (12) for air conditioning, a high temperature hot water supply unit (13), and a hot water storage unit (14). The hot water supply system (10) includes a first refrigerant circuit (20), an intermediate temperature water circuit (40), a second refrigerant circuit (60), and a high temperature water circuit (80).

The first refrigerant circuit (20) is formed, such that it extends between the heat source unit (11) and the indoor unit (12). Disposed along the first refrigerant circuit (20) are a first compressor (21), a four way switch valve (22), an outdoor heat exchanger (23), an indoor heat exchanger (24), a first heat exchanger (30), and two motor operated expansion valves (25, 26). Of these circuit components, only the indoor heat exchanger (24) is accommodated in the indoor unit (12) while the others are accommodated in the heat source unit (11). In addition, the first refrigerant circuit (20) is charged with a first refrigerant. As the first refrigerant, hydrocarbon (HC) refrigerants such as methane, propane et cetera may be used in addition to the so-called fluorocarbon refrigerant including R407C, R410A et cetera.

The outdoor heat exchanger (23) and the indoor heat exchanger (24) are plate and tube heat exchangers of the cross fin type. The outdoor heat exchanger (23) causes the first refrigerant to exchange heat with outdoor air. On the other hand, the indoor heat exchanger (24) causes the first refrigerant to exchange heat with indoor air. The indoor heat exchanger (24) constitutes a heat exchanger for providing air conditioning. The first heat exchanger (30) is implemented by a so-called plate heat exchanger. The first heat exchanger (30) is provided with a plurality of first flow paths (31) and a plurality of second flow paths (32) which are partitioned from each other.

The four way switch valve (22) has four ports and is so configured as to be selectively switchable between a first state (see FIG. 1) in which the first and third ports fluidly communicate with each other and the second and fourth ports fluidly communicate with each other and a second state (see FIG. 2) in which the first and fourth ports fluidly communicate with each other and the second and third ports fluidly communicate with each other.

In the first refrigerant circuit (20), the first compressor (21) is fluidly connected, at its discharge side, to the first port of the four way switch valve (22). The first compressor (21) is fluidly connected, at its suction side, to the second port of the four way switch valve (22). One end of the outdoor heat exchanger (23) is fluidly connected to the third port of the four way switch valve (22). The other end of the outdoor heat exchanger (23) is fluidly connected to both one end of the first motor operated expansion valve (25) and one end of the second motor operated expansion valve (26). The other end of the first motor operated expansion valve (25) is fluidly connected to one end of the indoor heat exchanger (24). The other end of the indoor heat exchanger (24) is fluidly connected to the fourth port of the four way switch valve (22). On the other hand, the other end of the second motor operated expansion valve (26) is fluidly connected to one end of the first flow path (31) in the first heat exchanger (30). The other end of the first flow path (31) in the first heat exchanger (30) is fluidly connected between the discharge side of the first compressor (21) and the four way switch valve (22).

The intermediate temperature water circuit (40) is formed, such that it extends between the heat source unit (11) and the high temperature hot water supply unit (13). Disposed along the intermediate temperature water circuit (40) are the first heat exchanger (30), a pump (41), a three way control valve (42), and a second heat exchanger (50). Of these circuit components, only the second heat exchanger (50) is accommodated in the high temperature hot water supply unit (13) while the others are accommodated in the heat source unit (11). The intermediate temperature water circuit (40) is fluidly connected to a radiator (45) for floor heating as a heat utilization unit. The intermediate temperature water circuit (40) constitutes a heating medium passageway which enables circulation of water (heat transfer water) charged as a heating medium) between the system and the floor heating radiator (45).

The heating medium which is charged in the intermediate temperature water circuit (40) is not limited to the water. For example, brine such as ethylene glycol aqueous solution et cetera may be used as a heating medium. In addition, the heat utilization unit to which the intermediate temperature water circuit (40) is fluidly connected is not limited to the floor heating radiator (45). For example, equipment, such as a hot water heating device, a bathroom drying device et cetera which are configured to heat air with heat transfer water, may be fluidly connected, as a heat utilization unit, to the intermediate temperature water circuit (40).

The three way control valve (42) having three ports is configured, such that it is capable of operation to deliver a fluid which has entered the first port to either one of the second and third ports and capable of operation to deliver a fluid which has entered the first port to both the second and third ports. In the latter operation, it is possible to vary the ratio of one portion of the fluid that is directed towards the second port to the other portion that is directed towards the third port. The second heat exchanger (50) is implemented by a so-called plate heat exchanger. The second heat exchanger (50) is provided with a plurality of first flow paths (51) and a plurality of second flow paths (52) which are partitioned from each other.

In the intermediate temperature water circuit (40), the discharge side of the pump (41) is fluidly connected to the first port of the three way control valve (42). One end of the first flow path (51) of the second heat exchanger (50) is fluidly connected to the second port of the three way control valve (42). The other end of the first flow path (51) is fluidly connected to one end of the second flow path (32) of the first heat exchanger (30). The second flow path (32) of the first heat exchanger (30) is fluidly connected, at the other end thereof, to the suction side of the pump (41). The third port of the three way control valve (42) is fluidly connected to one end of the floor heating radiator (45). The other end of the floor heating radiator (45) is fluidly connected to a pipeline which establishes fluid communication between the first flow path (51) of the second heat exchanger (50) and the second flow path (32) of the first heat exchanger (30).

The second refrigerant circuit (60) is accommodated in the high temperature hot water supply unit (13). Disposed along the second refrigerant circuit (60) are a second compressor (61), a third heat exchanger (70), a motor operated expansion valve (62), and the second heat exchanger (50). The second refrigerant circuit (60) is charged with a second refrigerant. As the second refrigerant, carbon dioxide ($CO_2$) is used.

The third heat exchanger (70) is implemented by a so-called plate heat exchanger. The third heat exchanger (70) is provided with a plurality of first flow paths (71) and a plurality of second flow paths (72) which are partitioned from each other.

In the second refrigerant circuit (60), the discharge side of the second compressor (61) is fluidly connected to one end of the first flow path (71) of the third heat exchanger (70). The first flow path (71) of the third heat exchanger (70) is fluidly connected, at the other end thereof, to one end of the second flow path (52) of the second heat exchanger (50) through the motor operated expansion valve (62). The second flow path (52) of the second heat exchanger (50) is fluidly connected, at the other end thereof, to the suction side of the second compressor (61).

The high temperature water circuit (80) is formed, such that it extends between the high temperature hot water supply unit (13) and the hot water storage unit (14). Disposed along the high temperature water circuit (80) are a hot water storage tank (81), a pump (82), the third heat exchanger (70), and a mixing valve (83).

The mixing valve (83) has three ports and is configured, such that it mixes together a fluid which has entered the first port and a fluid which has entered the second port and delivers the mixture of these fluids out of the third port. In addition, the mixing valve (83) is able to change the ratio of the flow rate between the fluid flowing into the first port and the fluid flowing into the second port. The hot water storage tank (81) is shaped like a longitudinally elongated, cylinder-shaped, hermetically-sealed container.

In the high temperature water circuit (80), the discharge side of the pump (82) is fluidly connected to one end of the second flow path (72) of the third heat exchanger (70). The second flow path (72) of the third heat exchanger (70) is fluidly connected, at the other end thereof, to the first port of the mixing valve (83). The second port of the mixing valve (83) is fluidly connected to the suction side of the pump (82). Fluidly connected to the third port of the mixing valve (83) is a hot water supply pipe (85) which extends towards the utilization side such a kitchen, a washstand, a bathroom et cetera. The hot water storage tank (81) is fluidly connected, at its bottom and top, to a pipeline fluidly connecting together the mixing valve (83) and the pump (82) and to a pipeline fluidly connecting together the second flow path (72) of the third heat exchanger (70) and the mixing valve (83), respectively. A supply of water is provided into the high temperature water circuit (80) from the outside and is then introduced to the vicinity of the suction side of the pump (82).

Running Operation

The running operation of the hot water supply system (10) is described. The hot water supply system (10) is selectively switchable between a cooling mode of operation in which the indoor unit (12) provides room cooling and a heating mode of operation in which the indoor unit (12) provides room heating.

In the first place, the operation of the first refrigerant circuit (20) is described.

As shown in FIG. 1, in the first refrigerant circuit (20) during the cooling mode operation, the four way switch valve (22) is set to the first state. In addition, in the first refrigerant circuit (20), the valve opening of the first motor operated expansion valve (25) is suitably adjusted while the valve opening of the second motor operated expansion valve (26) is set at an almost fully opened position. In this state, the first compressor (21) is placed in operation, and the first refrigerant is circulated in the first refrigerant circuit (20) to thereby perform a refrigeration cycle. During that time, in the first refrigerant circuit (20), the outdoor heat exchanger (23) and the first heat exchanger (30) become condensers while the indoor heat exchanger (24) becomes an evaporator. During the cooling mode operation, the first refrigerant circuit (20) constitutes a heat pump which uses the indoor air as a heat source.

More specifically, a part of the first refrigerant discharged out of the first compressor (21) passes through the four way switch valve (22) and flows into the outdoor heat exchanger (23) while the other first refrigerant flows into the first flow path (31) of the first heat exchanger (30). The first refrigerant which has entered the outdoor heat exchanger (23) dissipates heat to outdoor air and condenses. On the other hand, the first refrigerant which has entered the first flow path (31) of the first heat exchanger (30) dissipates heat to the heat transfer water in the intermediate temperature water circuit (40) and condenses, whereafter it passes through the second motor operated expansion valve (26) and joins the first refrigerant condensed in the outdoor heat exchanger (23). Subsequently, the united first refrigerant is reduced in pressure during passage through the first motor operated expansion valve (25) and then flows into the indoor heat exchanger (24). In the indoor heat exchanger (24), the inflow first refrigerant absorbs heat from indoor air and evaporates, and the indoor air is cooled. After passage through the four way switch valve (22), the first refrigerant evaporated in the indoor heat exchanger (24) is drawn into the first compressor (21) where it is compressed.

Figure 2:
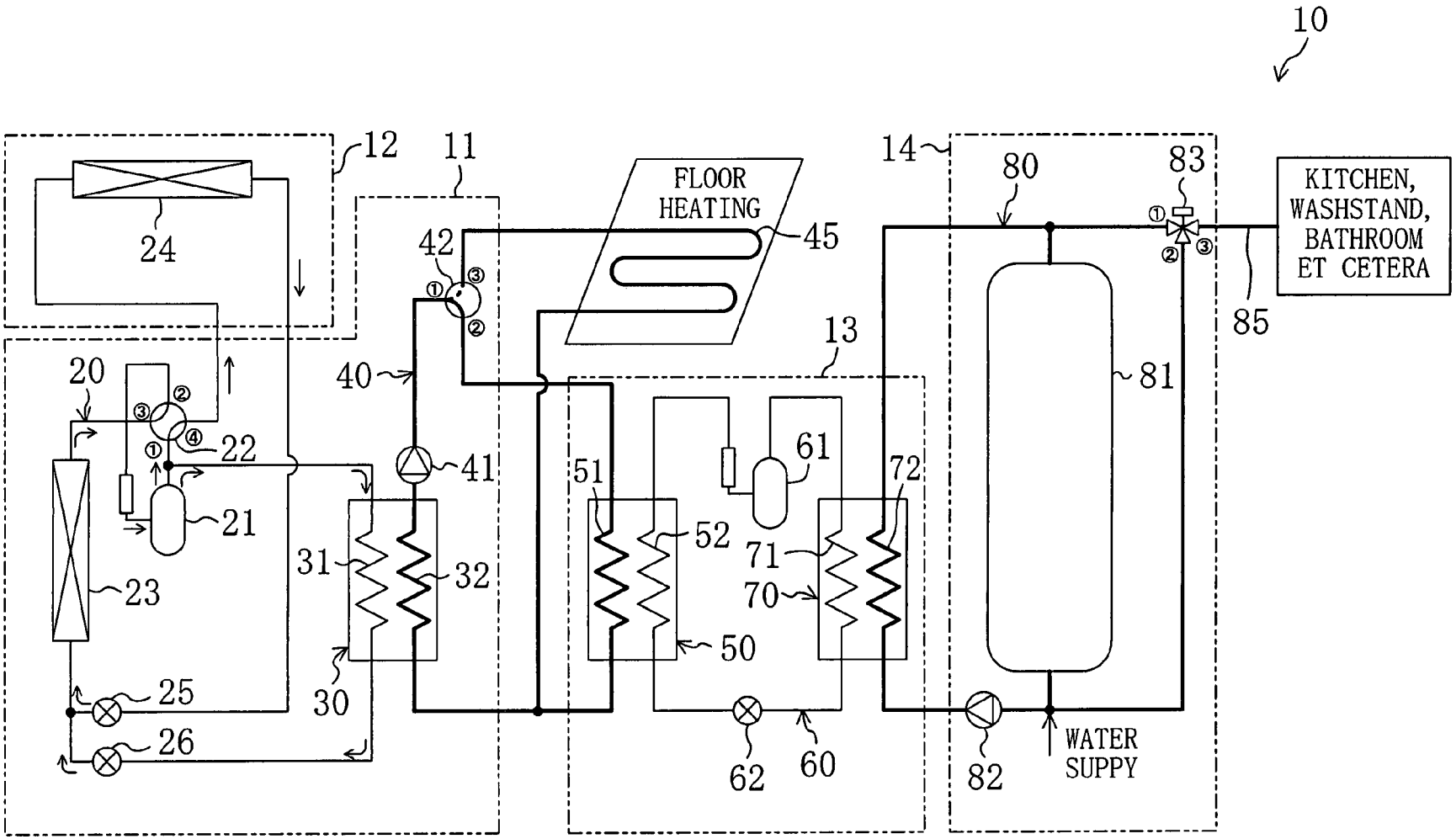
FIG. 2 is a piping schematic diagram showing a general configuration of a hot water supply system in an embodiment of the present invention, and an operation thereof during the heating mode of operation.

As shown in FIG. 2, in the first refrigerant circuit (20) during the heating mode operation, the four way switch valve (22) is set to the second state. In addition, in the first refrigerant circuit (20), the valve opening of each of the first and second motor operated expansion valves (25, 26) is suitably adjusted. In this state, the first compressor (21) is placed in operation and the first refrigerant is circulated in the first refrigerant circuit (20) to thereby perform a refrigeration cycle. During that time, in the first refrigerant circuit (20), the indoor heat exchanger (24) and the first heat exchanger (30) become condensers while the outdoor heat exchanger (23) becomes an evaporator. During the heating mode operation, the first refrigerant circuit (20) constitutes a heat pump which uses the outdoor air as a heat source.

More specifically, a part of the first refrigerant discharged out of the first compressor (21) passes through the four way switch valve (22) and flows into the indoor heat exchanger (24) while the other first refrigerant flows into the first flow path (31) of the first heat exchanger (30). In the indoor heat exchanger (24), the inflow refrigerant dissipates heat to indoor air and condenses, and the indoor air is heated. The first refrigerant which has entered the first flow path (31) of the first heat exchanger (30) dissipates heat to the heat transfer water in the intermediate temperature water circuit (40) and condenses. The first refrigerant condensed in the indoor heat exchanger (24) is reduced in pressure during passage through the first motor operated expansion valve (25) and then flows into the outdoor heat exchanger (23) while on the other hand the first refrigerant condensed in the first flow path (31) of the first heat exchanger (30) is reduced in pressure during passage through the second motor operated expansion valve (26) and then flows into the outdoor heat exchanger (23). In the outdoor heat exchanger (23), the inflow first refrigerant absorbs heat from outdoor air and evaporates. After passage through the four way switch valve (22), the first refrigerant evaporated in the outdoor heat exchanger (23) is drawn into the first compressor (21) where it is compressed.

In the following, the respective operations of the intermediate temperature water circuit (40), the second refrigerant circuit (60), and the high temperature water circuit (80) are described. These operations are the same, regardless of whether the system is in the cooling mode operation or in the heating mode operation.

When the pump (41) of the intermediate temperature water circuit (40) is placed in operation, heat transfer water circulates in the intermediate temperature water circuit (40). The heat transfer water which has entered the second flow path (32) of the first heat exchanger (30) is heated by the first refrigerant flowing in the first flow path (31) of the first heat exchanger (30). The heat transfer water is heated up to an intermediate temperature of about 30-60 degrees Centigrade during passage through the second flow path (32) and flows into the three way control valve (42). If the state of the three way control valve (42) is set such that the first port is brought into fluid communication with both the second port and the third port, then a part of the intermediate temperature heat transfer water flows into the floor heating radiator (45) while the other heat transfer water flows into the first flow path (51) of the second heat exchanger (50). Both the heat transfer water which has dissipated heat to indoor air et cetera in the floor heating radiator (45) and the heat transfer water which has dissipated heat to the second refrigerant in the second flow path (52) of the second heat exchanger (50) flow into the second flow path (32) of the first heat exchanger (30) where these heat transfer water flows are heated.

By controlling the three way control valve (42), the ratio of the flow rate between the heat transfer water flowing towards the floor heating radiator (45) and the heat transfer water flowing towards the second heat exchanger (50) can be changed. In addition, if the state of the three way control valve (42) is set such that the first port is brought into fluid communication only with the second port, the heat transfer water heated in the first heat exchanger (30) is supplied only to the second heat exchanger (50). In addition, if the state of the three way control valve (42) is set such that the first port is brought into fluid communication only with the third port, the heat transfer water heated in the first heat exchanger (30) is supplied only to the floor heating radiator (45).

When the second compressor (61) of the second refrigerant circuit (60) is placed in operation, the second refrigerant circulates in the second refrigerant circuit (60) to thereby perform a refrigeration cycle. During that time, in the second refrigerant circuit (60), the third heat exchanger (70) becomes a condenser and the second heat exchanger (50) becomes an evaporator. In addition, in the second refrigerant circuit (60), the high pressure of the refrigeration cycle is so set as to exceed the critical pressure of the second refrigerant. In other words, in the second refrigerant circuit (60), a so-called supercritical cycle is carried out. The second refrigerant circuit (60) constitutes a heat pump which uses the heat transfer water in the intermediate temperature water circuit (40) as a heat source.

More specifically, the second refrigerant discharged out of the second compressor (61) flows into the first flow path (71) of the third heat exchanger (70), dissipates heat to the water for hot water supply flowing through the second flow path (72) of the third heat exchanger (70), and condenses. The second refrigerant condensed in the third heat exchanger (70) is reduced in pressure during passage through the motor operated expansion valve (62) and then flows into the second flow path (52) of the second heat exchanger (50). The second refrigerant which has entered the second flow path (52) of the second heat exchanger (50) absorbs heat from the heat transfer water flowing through the first flow path (51) of the second heat exchanger (50) and evaporates. The refrigerant evaporated in the second heat exchanger (50) is drawn into the second compressor (61) where it is compressed.

When the pump (41) of the high temperature water circuit (80) is placed in operation, water for hot water supply is distributed in the high temperature water circuit (80). The water for hot water supply discharged out of the pump (82) flows into the second flow path (72) of the third heat exchanger (70), and is heated by the second refrigerant flowing through the first flow path (71). The water for hot water supply heated up to a high temperature of about 60-90 degrees Centigrade in the third heat exchanger (70) is either supplied to the utilization side by way of the hot water supply pipe (85) or stored in the hot water storage tank (81). In addition, by controlling the mixing valve (83), the ratio of the flow rate between the high temperature water for hot water supply which flows into the first port and the normal-temperature water which flows into the second port is changed, and the temperature of the hot water which flows into the hot water supply pipe (85) from the third port is adjusted.

Effects of the Embodiment

In the hot water supply system (10) of the present embodiment, the first refrigerant circuit (20) performs a refrigeration cycle to thereby heat heat transfer water in the intermediate temperature water circuit (40), and the second refrigerant circuit (60) performs, using the heat transfer water as a heat source, a refrigeration cycle to thereby heat water for hot water supply up to high temperatures ranging between about 60 degrees Centigrade and about 90 degrees Centigrade. Consequently, for example, when not the supply of hot water, but the supply of heat transfer water to the floor heating radiator (45) is requested, it suffices that only the first refrigerant circuit (20) performs a refrigeration cycle, and there is no need for the second refrigerant circuit (60) to perform a refrigeration cycle to thereby heat water for hot water supply to a high temperature. Accordingly, unlike the conventional technology, the hot water supply system (10) of the present embodiment eliminates the need to produce high temperature water in order just to obtain only an intermediate temperature heating medium, thereby making it possible to suppress wasteful consumption of electric power.

In the hot water supply system (10) of the present embodiment, the amount of heating applied to the heating medium in the first heat exchanger (30) is changed by making a variation in the operating capacity of the first compressor (21). Consequently, when the demand for intermediate temperature heat transfer water or the desired value of the temperature of heat transfer water is changed, it is possible to realize a corresponding operational status to such a change by controlling the operation of the first compressor (21). In addition, if the operating capacity of the second compressor (61) is changed in the hot water supply system (10), this causes the amount of heating applied to the water for hot water supply in the third heat exchanger (70) to vary. Consequently, when the demand for the supply of hot water or the desired value of the temperature of supply hot water is changed, it is possible to realize a corresponding operation status to such a change by controlling the operation of the second compressor (61).

In the way as described above, by individually controlling the operation of the first compressor (21) and the operation of the second compressor (21), it becomes possible to properly respond to the demand for intermediate temperature heat transfer water and to the demand for the supply of hot water. Therefore, in accordance with the present embodiment, it is possible to realize the hot water supply system (10) which is easily operation-controlled depending on the variation in load.

In addition, in the hot water supply system (10) of the present embodiment, it becomes capable of operation to distribute heat transfer water heated as a result of heat exchange with the first refrigerant to the floor heating radiator (45) and the second heat exchanger (50), and during this operation the second refrigerant in the second refrigerant circuit (60) absorbs heat from the intermediate temperature heat transfer water flowing out from the first heat exchanger (30). Stated another way, in the hot water supply system (10) of the present embodiment, it is arranged such that the second refrigerant in the second refrigerant circuit (60) is made to exchange heat with heat transfer water heated as high as possible. Therefore, in accordance with the present embodiment, the low pressure of the refrigeration cycle in the second refrigerant circuit (60) can be set at a rather high level, and the COP of the refrigeration cycle can be reduced by reducing the power consumption of the second compressor (61).

In addition, in accordance with the hot water supply system (10) of the present embodiment, it becomes possible to interrupt the supply of heat transfer water to the floor heating radiator (45) which is not requested to operate. This therefore makes it possible to avoid loss in the heat dissipation of the heating medium in the floor heating radiator (45) which is not requested to operate.

In addition, in accordance with the hot water supply (10) of the present embodiment, it becomes possible to provide room heating and room cooling by the use of the first refrigerant circuit (20). This therefore makes it possible to achieve more space-savings in the installation of equipment when compared to the case where the hot water supply system (10) is installed separately from an air conditioning apparatus.

Generally, a heat exchanger configured to cause refrigerant to exchange heat with water is smaller in size than one configured to cause refrigerant to exchange heat with air, when they are identical in heat exchange capacity with each other. On the other hand, in the hot water supply system (10) of the present embodiment, the second refrigerant circuit (60) for heating water for hot water supply in the high temperature water circuit (80) constitutes a heat pump which uses the heat transfer water in the intermediate temperature water circuit (40) as a heat source and the second heat exchanger (50) which becomes an evaporator in the second refrigerant circuit (60) is implemented by a plate heat exchanger configured to cause the second refrigerant to exchange heat with heat transfer water. Therefore, in accordance with the present embodiment, the hot water supply system (10) can be downsized substantially in comparison with the case where both the first refrigerant circuit (20) for heating the heat transfer water in the intermediate temperature water circuit (40) and the second refrigerant circuit (60) for heating the water for hot water supply in the high temperature water circuit (80) are heat pumps which use the air as a heat source.

First Variation of the Embodiment

In the hot water supply system (10) of the present embodiment, the configuration of the intermediate temperature water circuit (40) may be modified.

Figure 3:
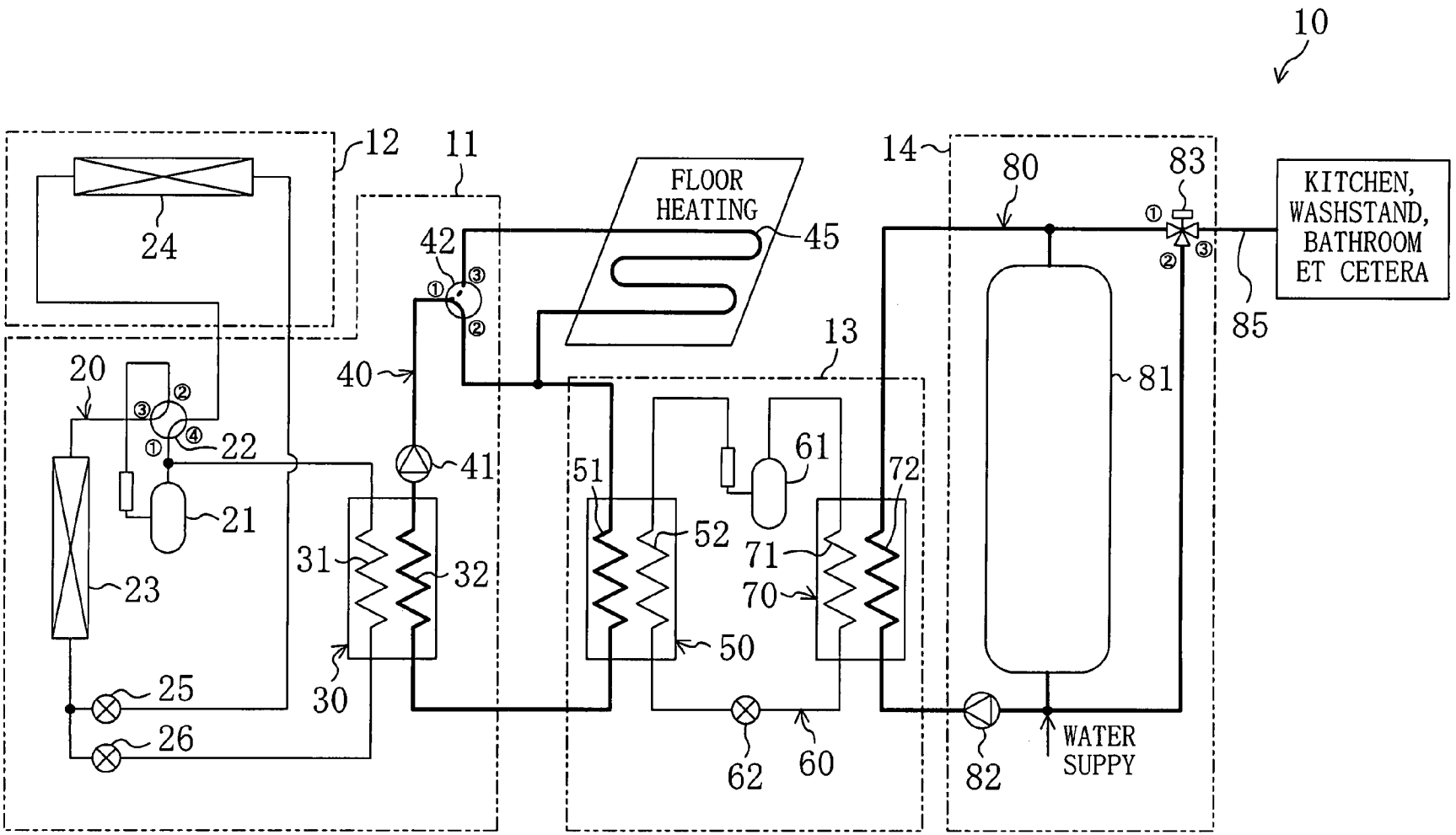
FIG. 3 is a piping schematic diagram showing a general configuration of a hot water supply system in a first variation of the embodiment.

More specifically, as shown in FIG. 3, it may be arranged such that the other end of the floor heating radiator (45) is fluidly connected to a pipeline of the intermediate temperature water circuit (40) that fluidly connects together the three way control valve (42) and the second heat exchanger (50). In the intermediate temperature water circuit (40) of the first variation, the heat transfer water after heat dissipation in the floor heating radiator (45) passes through the first flow path (51) of the second heat exchanger (50) and then flows into the second flow path (32) of the first heat exchanger (30).

In the way as described above, in the hot water supply system (10) of the first variation, it becomes capable of operation to supply the heat transfer water after passage through the floor heating radiator (45) to the second heat exchanger (50). During this operation, the heat transfer water which has dissipated heat in the floor heating radiator (45) further dissipates heat to the second refrigerant in the second heat exchanger (50) and then exchanges heat with the first refrigerant in the first heat exchanger (30). This consequently reduces the enthalpy of the first refrigerant at the exit of the first flow path (31) of the first heat exchanger (30), thereby making it possible to increase the amount of heat that the first refrigerant absorbs from the heat source such as outside air et cetera. Therefore, in accordance with the first variation, it becomes possible to improve the COP (coefficient of performance) of the refrigeration cycle in the first refrigerant circuit (20).

Second Variation of the Embodiment

In the hot water supply system (10) of the present embodiment, the configuration of the first refrigerant circuit (20) may be modified.

Figure 4:
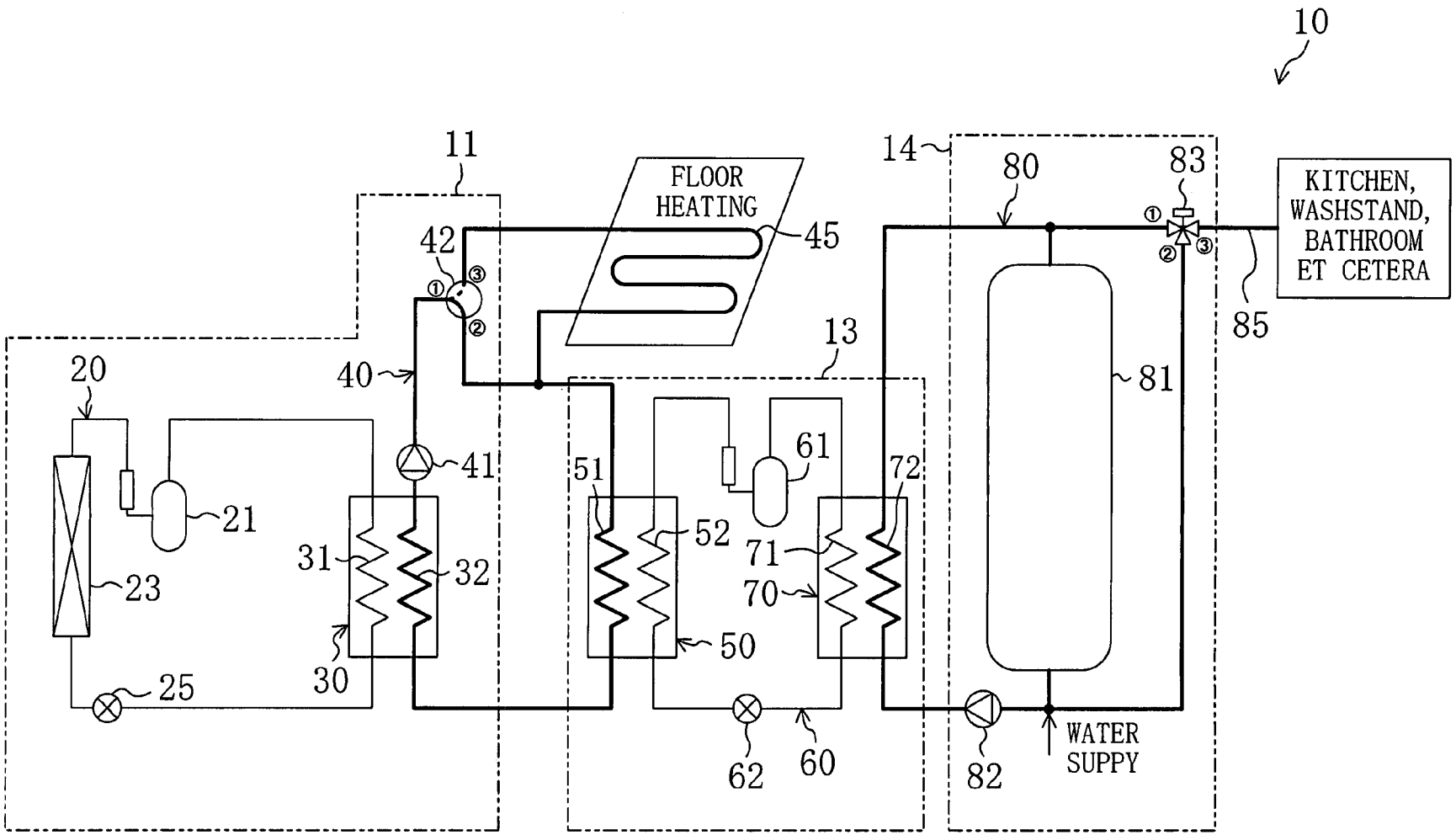
FIG. 4 is a piping schematic diagram showing a general configuration of a hot water supply system in a second variation of the embodiment.

More specifically, as shown in FIG. 4, it may be arranged such that the indoor heat exchanger (24) and the four way switch valve (22) are omitted in the first refrigerant circuit (20). In the first refrigerant circuit (20) of the second variation, the first compressor (21) is fluidly connected, at its discharge and suction sides, to the first flow path (31) of the first heat exchanger (30) and to the outdoor heat exchanger (23), respectively.

Third Variation of the Embodiment

In the hot water supply system (10) of the present embodiment, the first refrigerant circuit (20) may be provided in plural number. In this case, a plurality of first heat exchangers (30) are fluidly connected either in series or parallel to the intermediate temperature water circuit (40) and each first refrigerant circuit (20) is fluidly connected to an associated first flow path (31) of each of the first heat exchangers (30). And, even when only the operation of a single first refrigerant circuit (20) fails to provide a sufficient amount of heating to the heat transfer water, it is possible to supply such deficiency in the amount of heating by operating another first refrigerant circuit (20). Therefore, in accordance with the third variation, it is possible to realize the hot water supply system (10) capable of responding to a variation in the load with flexibility and having high usability.

Likewise, in the hot water supply system (10) of the present embodiment, the second refrigerant circuit (60) may be provided in plural number. In this case, a plurality of second heat exchangers (50) are fluidly connected either in series or parallel to the intermediate temperature water circuit (40) and each second refrigerant circuit (60) is fluidly connected to an associated second flow path (52) of each of the second heat exchangers (50).

Fourth Variation of the Embodiment

In the hot water supply system (10) of the present embodiment, the high temperature hot water supply unit (13) and the hot water storage unit (14) may be made integral with each other. In other words, the second refrigerant circuit (60) and the high temperature water circuit (80) may be accommodated in the same single casing. If the high temperature hot water supply unit (13) and the hot water storage unit (14) are made integral with each other, this makes it possible to reduce the installation area of the hot water supply system (10).

INDUSTRIAL APPLICABILITY

As has been described above, the present invention has useful application in the field of hot water supply systems.

What is claimed is:

1. A hot water supply system which, in addition to being capable of operation to supply hot water to a utilization side, is also capable of operation to supply to a heat utilization unit (45) a heating medium as a heating fluid having an intermediate temperature lower than the temperature of the hot water, the hot water supply system comprising:

(i) a heating medium passageway (40) for causing the heating medium to circulate between the hot water supply system and the heat utilization unit (45);

(ii) a first refrigerant circuit (20) which performs a refrigerant cycle by causing a first refrigerant to circulate and which heats the heating medium in the heating medium passageway (40) up to the intermediate temperature by heat exchange with the first refrigerant; and (iii) a second refrigerant circuit (60) which performs a refrigeration cycle by causing a second refrigerant to circulate and which heats water with the second refrigerant to thereby produce hot water for hot water supply, wherein the second refrigerant circuit (60) comprises an evaporator which causes the second refrigerant to exchange heat with the heating medium in the heating medium passageway (40) and which constitutes a heat pump using the heating medium in the heating medium passageway (40) as a heat source.

2. The hot water supply system of claim 1 wherein the heating medium passageway (40) is capable of operation to supply the heating medium after passage through the heat utilization unit (45) to the evaporator (50) of the second refrigerant circuit (60).

3. The hot water supply system of claim 1 wherein the heating medium passageway (40) is capable of operation to distribute the heating medium heated up to the intermediate temperature to the heat utilization unit (45) and the evaporator (50) of the second refrigerant circuit (60).

4. The hot water supply system of either of claims 2 or 3 wherein the heating medium passageway (40) is capable of operation to supply the heating medium heated up to the intermediate temperature only to the evaporator (50) of the second refrigerant circuit (60).

5. The hot water supply system of claim 1 wherein the first refrigerant circuit (20) is provided with a heat exchanger unit (24) for air conditioning which causes the first refrigerant to exchange heat with indoor air.

6. The hot water supply system of claim 5 wherein the first refrigerant circuit (20) is selectively switchable between a first mode of operation in which the air conditioning heat exchanger unit (24) becomes an evaporator and a second mode of operation in which the air conditioning heat exchanger unit (24) becomes a condenser.

7. The hot water supply system of claim 1 wherein:

(i) either or both of the first refrigerant circuit (20) and the second refrigerant circuit (60) are provided in plural numbers while only one heating medium passageway (40) is provided; and (ii) the first refrigerant in each of the first refrigerant circuits (20) and the second refrigerant in each of the second refrigerant circuits (60) exchange heat with the heating medium circulating in the only one heating medium passageway (40).

* * * * *